US009061335B2

(12) United States Patent
Serizawa et al.

(10) Patent No.: US 9,061,335 B2
(45) Date of Patent: Jun. 23, 2015

(54) COOLING APPARATUS AND COOLING METHOD FOR HOT ROLLING

(75) Inventors: Yoshihiro Serizawa, Tokyo (JP); Shigeru Ogawa, Tokyo (JP); Yoji Nakamura, Tokyo (JP); Tooru Akashi, Tokyo (JP); Noriyuki Hishinuma, Tokyo (JP); Tetsuo Kishimoto, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 485 days.

(21) Appl. No.: 13/497,698

(22) PCT Filed: Oct. 7, 2009

(86) PCT No.: PCT/JP2009/005223

§ 371 (c)(1), (2), (4) Date: Mar. 22, 2012

(87) PCT Pub. No.: WO2011/042934

PCT Pub. Date: Apr. 14, 2011

(65) Prior Publication Data

US 2012/0174645 A1 Jul. 12, 2012

(51) Int. Cl.

*B21B 45/02* (2006.01)
*B21B 39/00* (2006.01)

(52) U.S. Cl.

CPC ..... *B21B 45/0218* (2013.01); *B21B 39/006* (2013.01); *B21B 2261/20* (2013.01); *B21B 2265/02* (2013.01)

(58) Field of Classification Search

CPC .. B21B 39/006; B21B 39/08; B21B 45/0218; B21B 45/0233; B21B 2261/20; B21B 2265/02
USPC ..... 72/200, 201, 205, 183; 148/602
See application file for complete search history.

(56) References Cited

U.S. PATENT DOCUMENTS

2007/0074794 A1* 4/2007 Fujibayashi et al. ..... 148/645

FOREIGN PATENT DOCUMENTS

| | | |
|---|---|---|
| CN | 1153537 | 7/1997 |
| JP | 62-130961 | 6/1987 |
| JP | 02-065405 | 5/1990 |
| JP | 05-007917 | 1/1993 |
| JP | 9-52108 | 2/1997 |
| JP | 09-201614 | 8/1997 |
| JP | 2001-321816 | 11/2001 |

(Continued)

OTHER PUBLICATIONS

Office Action dated Nov. 4, 2013 issued in corresponding Chinese Application No. 200980161807.0 [With English Translation of Search Report].

International Search Report dated Nov. 17, 2009, issued in corresponding PCT Application No. PCT/JP2009/005223.

Japanese Office Action dated Nov. 22, 2011, issued in corresponding Japanese Application No. 2009-093352, and an English translation thereof.

(Continued)

*Primary Examiner* — Debra Sullivan
(74) *Attorney, Agent, or Firm* — Kenyon & Kenyon LLP

(57) ABSTRACT

A cooling apparatus for hot rolling is installed on a downstream side of a finishing mill of a continuous hot rolling mill, and cools a steel sheet rolled by the finishing mill while being conveyed. The cooling apparatus includes first pinch rolls which, during an interval when the steel sheet fed out from a final stand of the finishing mill moves from a position of the final stand to a position where a surface temperature of the steel sheet reaches 850° C. or less, pinch the steel sheet while applying tension of 3.9 MPa or greater.

4 Claims, 6 Drawing Sheets

(56) References Cited

FOREIGN PATENT DOCUMENTS

| | | |
|---|---|---|
| JP | 2003-136108 | 5/2003 |
| JP | 2006-035233 | 2/2006 |
| JP | 2007-038299 | 2/2007 |

OTHER PUBLICATIONS

Search Report dated Aug. 8, 2014 issued in corresponding European Application No. 09850211.5.

* cited by examiner

PRIOR ART

PRIOR ART

COOLING APPARATUS AND COOLING METHOD FOR HOT ROLLING

This application is a national stage application of International Application No. PCT/JP2009/005223, filed Oct. 7, 2009.

TECHNICAL FIELD

The present invention relates to a cooling apparatus and a cooling method for cooling a steel sheet on a run-out table after finish rolling is performed during continuous hot rolling of the steel sheet.

BACKGROUND ART

A steel material discharged from a furnace is sent via a roughing mill to a finishing mill. FIG. 6 is a perspective view showing an example of a layout of a hot rolling mill which performs a hot rolling process following on from a finishing mill 102. As shown in this FIG. 6, the steel material undergoes continuous rolling in a finishing mill 102 provided with a plurality of stands F1*a* to F7*a*. Then, a steel sheet 103 hot rolled to a desired thickness via the final stand F7*a*, is conveyed by a run-out table 104 provided with a plurality of conveying rollers 104*a*.

The run-out table 104 is installed inside a cooling apparatus 105 located on the downstream side of the finishing mill 102. Moreover, from a plurality of cooling units 106 provided above this run-out table 104, cooling water is sprayed onto the top surface of the steel sheet 103, thereby cooling the steel sheet 103. The cooled steel sheet 103 is wound onto a coiler 108 via coiler-preceding pinch rolls 107. The coiler-preceding pinch rolls 107 serve the role of guiding the steel sheet 103 to the coiler 108, and the role of maintaining back tension after the trailing end of the steel sheet 103 has passed through the final stand F7*a* of the finishing mill 102. In FIG. 6, the finishing mill 102 has 7 stands, but in some cases may have 6 stands.

In such a conventional hot rolling mill, the leading end of the high-temperature steel sheet 103 having passed through the final stand F7*a* of the finishing mill 102, in the interval before reaching the coiler-preceding pinch rolls 107, is fed out in an unpinched state. The steel sheet 103, if tension is not applied to the leading end thereof, may present waviness, and retain the wavy shape while passing through the inside of the cooling apparatus 105. For example, even if tension is applied to the steel sheet 103, the steel sheet 103 may vibrate during threading. If the cooling water is sprayed with the shape of the steel sheet 103 not flat or the steel sheet 103 in a vibrating state, variation in the application of the cooling water occurs in various positions on the steel sheet 103, resulting in temperature differences. For example, if waviness occurs in the shape of the steel sheet 103, surfaces which rise into mounds are formed upon this steel sheet 103. Of these raised surfaces, the cooling water strongly impacts those parts on the upstream side in the conveying direction of the steel sheet 103, but the cooling water impacts those parts on the downstream side in the conveying direction relatively weakly compared to those parts on the upstream side in the conveying direction. This is because the steel sheet 103 moves continuously in one direction.

Conventionally, for the reason described above, because temperature differences occur even when attempting to perform cooling uniformly across the surface of the steel sheet 103, manufacturing a steel sheet 103 having stable quality is difficult.

As described above, in a state in which tension is not applied to the steel sheet 103, waviness may occur in the shape of the steel sheet 103 having passed through the final stand F7*a* of the finishing mill 102. The trailing end of the steel sheet 103, after passing through each stand F1*a* to F7*a* of the finishing mill 102, remains in an unpinched state, without the application of tension, while passing through each subsequent stand F2*a* to F7*a*. In this case, in the same manner, the steel sheet 103 may not attain a flat shape, and large waviness may occur. Furthermore, even when tension is applied to the steel sheet 103 for example, the steel sheet 103 sometimes vibrates during threading. In this manner, if the steel sheet 103 is cooled in a state where waviness exist or a state where vibrations occur, variation in the cooling state occurs at various positions on the steel sheet 103, and variation in the quality of the steel sheet 103 increases further.

Incidentally, when the relationship of the boiling heat transfer characteristics resulting from water cooling with respect to the steel material surface temperature and the cooling capacity (heat transfer coefficient) is expressed, the relationship shown in FIG. 7 is obtained. In other words, as shown in FIG. 7, the interval where the steel material surface temperature is from $T_{CH}$ to $T_M$ is the transition boiling region, and beyond $T_M$ is the film boiling region. Moreover, $T_{CH}$ which indicates the boundary between the nucleate boiling region and the transition boiling region is 400 to 450° C. or thereabouts, and $T_M$ is 550 to 600° C. or thereabouts.

In the transition boiling region, if the surface temperature of the steel material decreases slightly, the cooling capacity of the water cooling increases sharply. Accordingly, as shown in FIG. 7, for example, if a position point B has a slightly higher surface temperature in the film boiling region than another position point A of the steel material, and water cooling is performed simultaneously on these two points, the steel material surface temperature changes as shown in FIG. 8. In other words, because the steel material surface temperature at point A is closer to $T_M$ than that at point B, point A reaches the transition boiling region immediately and a sharp drop in temperature is seen. On the other hand, because the surface temperature of point B, for a brief period, is within the film boiling region (because point B takes more time to reach $T_M$ than point A), the drop in temperature is less drastic, and the transition boiling region is reached later than at point A, after which the temperature begins to drop sharply. Accordingly, for a given period, a large temperature difference occurs between point A and point B.

That is to say, in the case where deviations occur in the application of the cooling water to various positions on the surface of the steel sheet 103 due to waviness in the steel sheet 103 and other factors, then this gives rise to a slight temperature difference between positions on the surface of the steel sheet 103. As a result, between each position, the timing of entering the transition boiling region is slightly different. Due to these slight differences in timing, the temperature differences between the positions widen sharply, and consequently a uniform steel sheet 103 material cannot be obtained. Accordingly, to stabilize the quality of the steel sheet 103, it is important that the steel sheet 103 prior to reaching the transition boiling region, is in a uniform state without waviness, and a state of minimal steel sheet vibration.

In Patent Document 1 below, the applicant proposed a rolling equipment in which one or more sets of pinch rolls are provided on the run-out table.

REFERENCE DOCUMENTS

[Patent Document 1] Japanese Unexamined Patent Application, First Publication No. 2001-321816

DISCLOSURE OF INVENTION

Problems to be Solved by the Invention

In the invention disclosed in Patent Document 1, the object is to reduce necking in the width direction of the steel sheet, and a configuration is disclosed where at least one set of pinch rolls are installed and these are installed at a position where the temperature of the steel sheet is 650° C. or less.

Normally, the surface temperature of the steel sheet immediately after passing through the finishing mill is within a range from approximately 840° C. to 1,000° C., and in order to reach the 650° C. disclosed in Patent Document 1, a long distance is required for a cooling step after passing through the finishing mill. Consequently, in the interval until the leading end of the steel sheet reaches the pinch rolls positioned a long distance from the final stand of the finishing mill, the leading end of the steel sheet is not pinched. In addition, regarding the application of tension to the steel sheet, no particular disclosure is made in Patent Document 1. Accordingly, in the technique disclosed in Patent Document 1, there is no reference to a technique that sufficiently improves the wavy shape of the leading end and trailing end of the steel sheet and the vibration of the steel sheet, which produce the temperature deviations such as mentioned above.

The present invention takes into consideration the above circumstances, with an object of providing a cooling apparatus and cooling method for hot rolling which, in a cooling step performed after a finishing step when subjecting a steel sheet to continuous hot rolling, can stabilize the shape of the leading end and trailing end of the steel sheet, and suppress vibration of the steel sheet.

Means for Solving the Problems

In order to solve the above problems, the present invention employs the following measures.

(1) A cooling apparatus for hot rolling according to the present invention is installed on a downstream side of a finishing mill of a continuous hot rolling mill, and cools a steel sheet rolled by the finishing mill while being conveyed. The cooling apparatus is provided with first pinch rolls which, during an interval when the steel sheet fed out from a final stand of the finishing mill moves from a position of the final stand to a position where a surface temperature of the steel sheet reaches 850° C. or less, pinch the steel sheet while applying tension of 3.9 MPa or greater.

According to the cooling apparatus for hot rolling disclosed in (1) above, by applying tension of 3.9 MPa or greater to the steel sheet within the range from the position of the final stand to the position where the surface temperature of the steel sheet reaches 850° C. or less, waviness in the shape of the steel sheet caused by the rolling process can be minimized. In particular, the application of tension to the leading end and trailing end of the steel sheet, where nonuniform cooling caused by waviness tends to occur, is effective in terms of obtaining uniform cooling along the entire length of the steel sheet.

(2) In the cooling apparatus for hot rolling disclosed in (1) above, the first pinch rolls may be installed at a position of the steel sheet immediately after where the surface temperature is cooled to 850° C.

(3) In the cooling apparatus for hot rolling disclosed in (1) above, a lower limit of the surface temperature of the steel sheet at the position where tension is applied may exceed 650° C.

(4) In the cooling apparatus for hot rolling disclosed in any one of (1) to (3) above, the cooling apparatus may further be provided with: second pinch rolls installed at a position where a surface temperature of the steel sheet is from 650° C. to 550° C.; and third pinch rolls installed at a position where a surface temperature of the steel sheet is from 450° C. to 350° C., and may adopt a configuration in which the second pinch rolls and the third pinch rolls apply tension of 3.9 MPa or greater between a position of the steel sheet where the second pinch rolls are installed and a position of the steel sheet where the third pinch rolls are installed.

(5) A cooling method for hot rolling of the present invention, on a downstream side of a finishing mill of a continuous hot rolling mill, cools a steel sheet rolled by the finishing mill while being conveyed, and is provided with: a first step of controlling a surface temperature of the steel sheet fed out from a final stand of the finishing mill to 850° C. or lower; and a second step of pinching the steel sheet while applying tension of 3.9 MPa or greater, from a position of the final stand to a position where a surface temperature of the steel sheet reaches 850° C. or less.

(6) In the cooling method for hot rolling disclosed in (5) above, in the second step, the tension may be applied at a position immediately after where the surface temperature of the steel sheet is cooled to 850° C.

(7) In the cooling method for hot rolling disclosed in (5) above, in the first step, a lower limit of the surface temperature at a position where the tension is applied in the subsequent second step is a temperature exceeding 650° C.

(8) The cooling method for hot rolling disclosed in any one of (5) to (7) above may further be provided with a third step in which, between a position where the surface temperature of the steel sheet reaches 650° C. to 550° C., and a position where the surface temperature of the steel sheet reaches 450° C. to 350° C., tension of 3.9 MPa or greater is applied.

Effects of the Invention

According to the present invention, the shape of the leading end and the trailing end of the steel sheet can be improved, and vibration of the steel sheet during threading can be suppressed. Thus, because the steel sheet surface can be uniformly cooled, a steel sheet having stable quality can be manufactured.

BEST MODE FOR CARRYING OUT THE INVENTION

Figure 1:
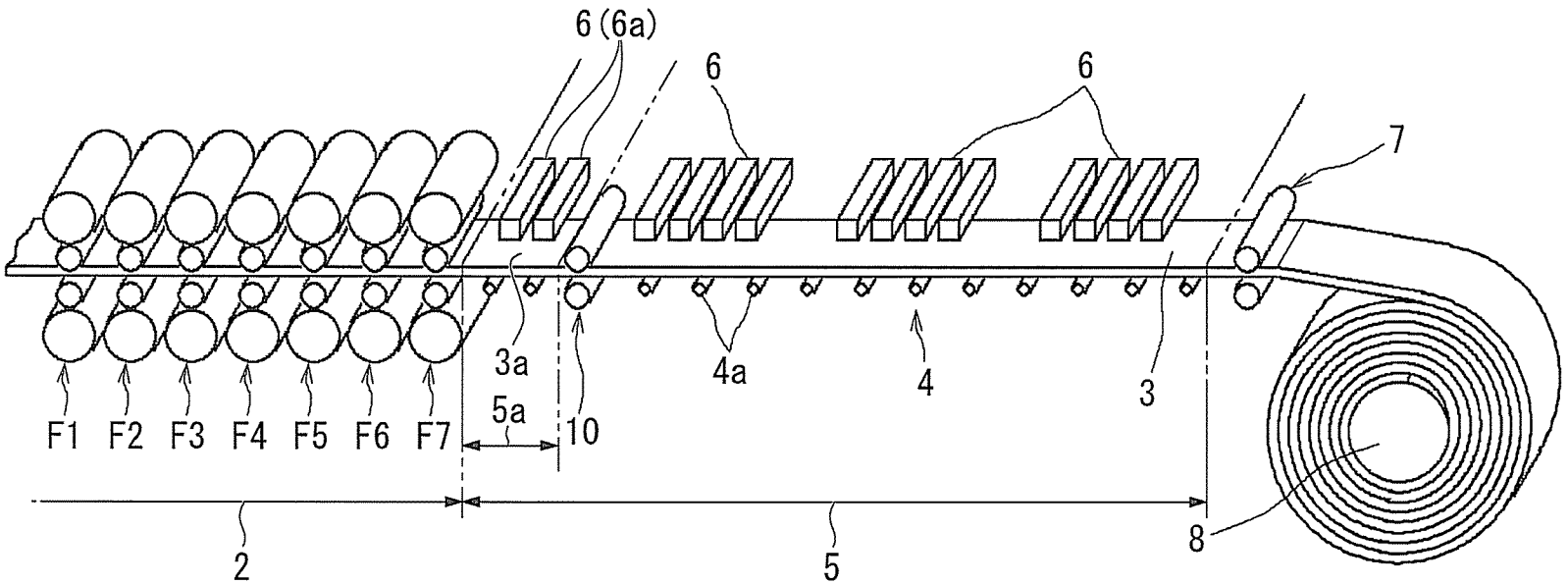
FIG. 1 is a perspective view showing an overview of hot rolling equipment provided with a cooling apparatus for hot rolling according to a first embodiment of the present invention.

The present invention relates to a cooling apparatus and cooling method for hot rolling which is installed on the downstream side of a finishing mill of a continuous hot rolling mill, and cools a steel sheet rolled by the finishing mill while being conveyed. The present embodiments will be explained below with reference to the drawings. Moreover, in the description of the various embodiments, elements which have substantially the same function and configuration are assigned the same reference numerals and overlapping descriptions thereof are omitted.

Embodiment 1

A steel material discharged from a furnace, after being rolled to a thickness of 40 mm or thereabouts by a roughing mill (omitted in the figures above), is subjected to continuous rolling in a finishing mill 2 described later, to a thickness of 1 mm to 4 mm or thereabouts.

FIG. 1 is a perspective view of a hot rolling mill having a cooling apparatus 5 for hot rolling according to the present embodiment (hereafter abbreviated to a cooling apparatus 5), showing an overview of the apparatus configuration from the finishing mill 2 onward. The finishing mill 2 is provided with a plurality (for example, 7 in the illustrated example) of stands F1 to F7, and performs hot rolling so as to obtain a steel sheet 3 having a desired sheet thickness and sheet width at the point when the steel material has passed through the final stand F7. The surface temperature of the steel sheet 3 immediately after passing through the final stand F7 of the finishing mill 2 is within a range from 840° C. to 1,000° C.

The steel sheet 3 after passing through the final stand F7 is conveyed to a run-out table 4 provided with a plurality of conveying rolls 4*a*. A plurality of cooling units 6 are installed directly above the run-out table 4. The steel sheet 3, while being conveyed upon the run-out table 4, is cooled by water or the like sprayed from the cooling units 6, and as a result, a metallographic structure with the desired properties is formed in the steel sheet 3. Each cooling unit 6 has cooling properties unique to the respective installation position thereof, and is controlled by a control device (not shown in the figure).

Furthermore, inside the cooling apparatus 5, the range between the final stand F7 and rolled shape correcting pinch rolls 10 (first pinch rolls) described later serves as an immediate rapid cooling zone 5*a* which subjects the steel sheet 3, which passes through the final stand F7 at a surface temperature within a range from 840° C. to 1000° C., to rapid cooling to a temperature of 850° C. or lower by means of rapid cooling units 6*a*. The rapid cooling units 6*a* directly above this immediate rapid cooling zone 5*a* form part of the cooling units 6, and as the quantity thereof, one or a plurality of units may be used.

The steel sheet 3 which has passed through the cooling apparatus 5 and cooled to a predetermined surface temperature (for example 430° C.) is wound onto a coiler 8. On the upstream side of the coiler 8 and the downstream side of the cooling apparatus 5, coiler-preceding pinch rolls 7 which include an upper and lower pair of rolls are provided. The steel sheet 3 is guided to the coiler-preceding pinch rolls 7, and wound onto the coiler 8 while correcting the wound shape thereof by the application of an appropriate tension to the section between the coiler-preceding pinch rolls 7 and the coiler 8.

At the position immediately after where the surface temperature of the steel sheet 3 that has passed through the immediate rapid cooling zone 5*a* on the downstream side of the final stand F7 of the finishing mill 2, has cooled to 850° C. or lower, there are installed rolled shape correcting pinch rolls 10 which include an upper and lower pair of rolls and are capable of correcting waviness in the width direction of the steel sheet 3.

These rolled shape correcting pinch rolls 10 pinch the steel sheet 3 fed out from the final stand F7 of the finishing mill 2, and rotate while applying tension of 3.9 MPa or greater to a section 3*a* between the position of the final stand F7 and the position at which the surface temperature of the steel sheet 3 reaches 850° C. or lower, thereby conveying the steel sheet 3 towards the downstream side. The lower limit of the surface temperature of the steel sheet 3 at the position where the tension is applied, is preferably more than 650° C.

The installation position of the rolled shape correcting pinch rolls 10 is preferably positioned as near as possible to the final stand F7, but a position where the temperature of the steel sheet 3 exceeds 850° C. is not preferable, due to concern that the pinching by the rolled shape correcting pinch rolls 10 might alter the thickness of the steel sheet 3. Accordingly, the rolled shape correcting pinch rolls 10 are preferably installed at a position immediately after where the steel sheet surface reaches 850° C. or lower, or at least at a position before entering the transition boiling region where the steel sheet surface is 650° C. or higher.

Furthermore, the pinch roll diameter and rolling force and the like of the rolled shape correcting pinch rolls 10 are preferably set so as not to change the thickness of the steel sheet 3. In the manner of the present embodiment, when the immediate rapid cooling zone 5*a* is provided adjacent to the downstream side of the finishing mill 2, the rolled shape correcting pinch rolls 10 are preferably provided immediately after the immediate rapid cooling zone 5*a*. By providing the immediate rapid cooling zone 5*a*, the position where the surface temperature of the steel sheet 3 reaches 850° C. or lower is brought close to the finishing mill 2, and consequently the distance between the rolled shape correcting pinch rolls 10 and the finishing mill 2 in the conveying direction can be shortened.

Conversely, in a case where only steel sheets that are subjected to finish rolling temperatures in the vicinity of 840° C. are manufactured, the immediate rapid cooling zone 5*a* and the rapid cooling units 6*a* can be omitted.

When the leading end of the steel sheet 3 has passed through the final stand F7 of the finishing mill 2 and reaches the position of the rolled shape correcting pinch rolls 10, the steel sheet 3 is pinched by the rolled shape correcting pinch rolls 10. Because the section on the trailing end side of the steel sheet 3 is pinched by the various stands F1 to F7 of the finishing mill 2, the leading end thereof can be pinched by the rolled shape correcting pinch rolls 10 such that tension of 3.9 MPa or greater is applied between the leading end and the final stand F7. As a result, the steel sheet 3 maintains a flat shape without waviness while being conveyed.

If the installation position of the rolled shape correcting pinch rolls 10 is not suitable, the position where the tension is applied to the steel sheet 3 is also not suitable. However, in the present embodiment, because the installation position of the rolled shape correcting pinch rolls 10 is suitable position as mentioned above, stabilization of the shape of the leading end and trailing end of the steel sheet 3, and suppression of vibration of the steel sheet can be realized in a reliable manner.

As the upper limit of the tension applied to the steel sheet 3 by the rolled shape correcting pinch rolls 10, 19.6 MPa is preferred.

Figure 2:
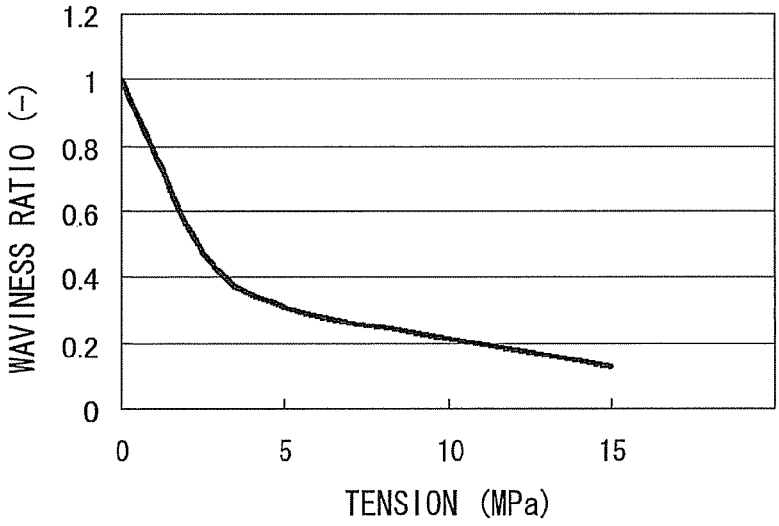
FIG. 2 is a graph showing variation in waviness ratio when tension is applied to a steel sheet.

FIG. 2 is a graph showing variation in waviness ratio when tension is applied to the steel sheet 3. That is to say, FIG. 2 is a graph showing the waviness ratio of the steel sheet 3 when tension is applied, with respect to a waviness ratio of the steel sheet 3 of 1 for when tension is not applied.

Figure 3:
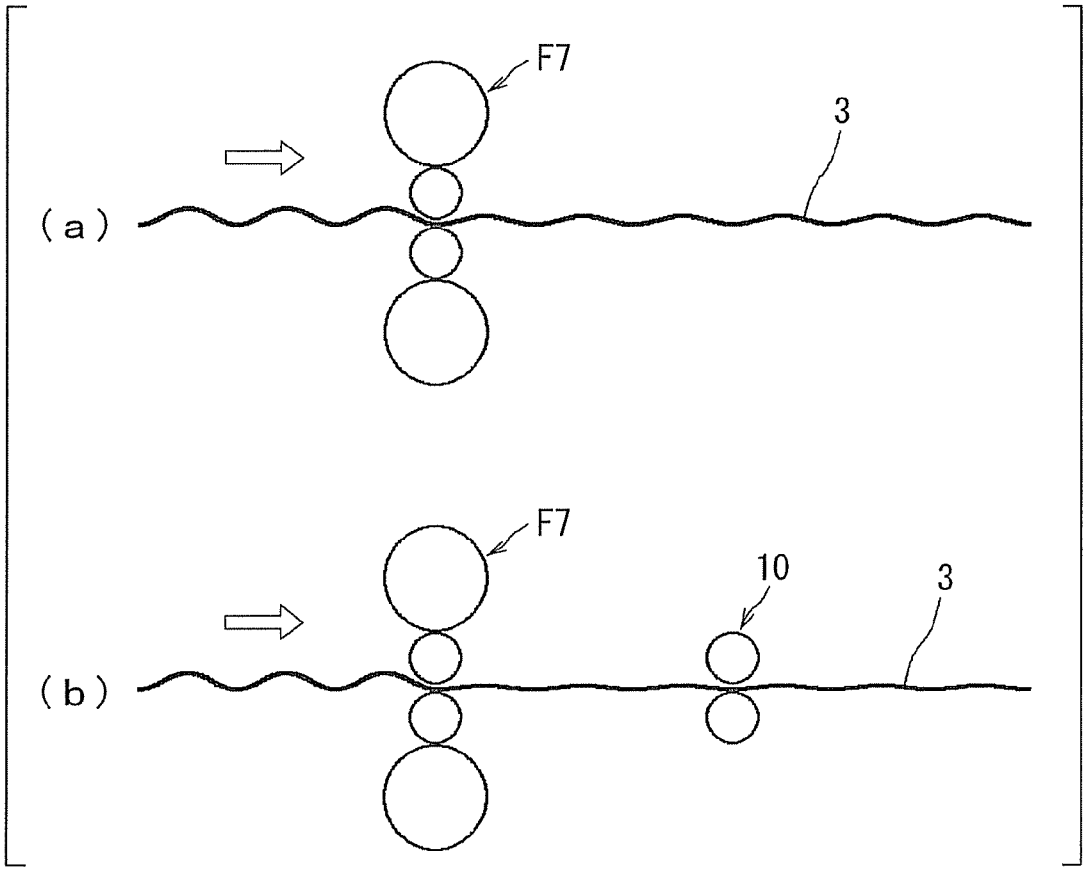
FIG. 3 is an explanatory view schematically showing an effect of rolled shape correcting pinch rolls installed in the cooling apparatus, where (a) shows a conventional case in which rolled shape correcting pinch rolls are not provided, and (b) shows the case of the present embodiment in which rolled shape correcting pinch rolls are provided.

Furthermore, FIG. 3 is an explanatory view schematically showing an effect of the tension applied by the rolled shape correcting pinch rolls 10, where (a) shows a conventional case in which the rolled shape correcting pinch rolls 10 are not provided, and (b) shows the case of the present embodiment in which the rolled shape correcting pinch rolls 10 are provided. That is to say, FIG. 3 shows the difference in reduction of the sinusoidal waviness, depending on whether or not tension is applied to the steel sheet 3 after passing through the final stand F7 of the finishing mill 2.

A simulated calculation was performed assuming that the thickness of the steel sheet 3 prior to rolling by the final stand F7 is 3.3 mm, and the thickness after rolling is 3 mm. As a result, in a case where the height of the waviness after rolling is 30 mm, if the rolled shape correcting pinch rolls 10 are provided and tension of 3.9 MPa is applied to the section 3*a* between the rolled shape correcting pinch rolls 10 and the final stand F7, the height of the waviness after rolling is reduced to approximately ⅓ as shown in FIG. 2.

In addition, as shown in (b) of FIG. 3, when the tension is released, that is after the steel sheet 3 has passed through the rolled shape correcting pinch rolls 10, the waviness of the steel sheet 3 remained reduced. Accordingly, if tension is applied, even after the steel sheet 3 has passed through the rolled shape correcting pinch rolls 10, clearly the steel sheet 3 is conveyed without having waviness. Furthermore, the amount by which the waviness reduces when tension of 14.7 MPa is applied is approximately ⅛ as shown in FIG. 2. In regions where the tension is 3.9 MPa or greater, as shown in FIG. 2, the degree of waviness is less than that in regions where the tension is lower than 3.9 MPa.

As described above, by applying tension using the rolled shape correcting pinch rolls 10 to the section 3*a* that is the appropriate region of the steel sheet 3, even if waviness is present in the steel sheet 3 after passing through the finishing mill 2, the shape thereof can be flattened.

Furthermore, because the steel sheet 3 maintains a flat shape when passing through the cooling apparatus 5, the cooling water sprayed from the cooling units 6 is applied evenly to the surface of the steel sheet 3. As a result, because the various locations on the surface of the steel sheet 3 are cooled under uniform cooling conditions, the metallographic structure at the various locations is formed in a stable manner (that is, a metallographic structure which presents little difference between the various locations can be produced).

Figure 4:
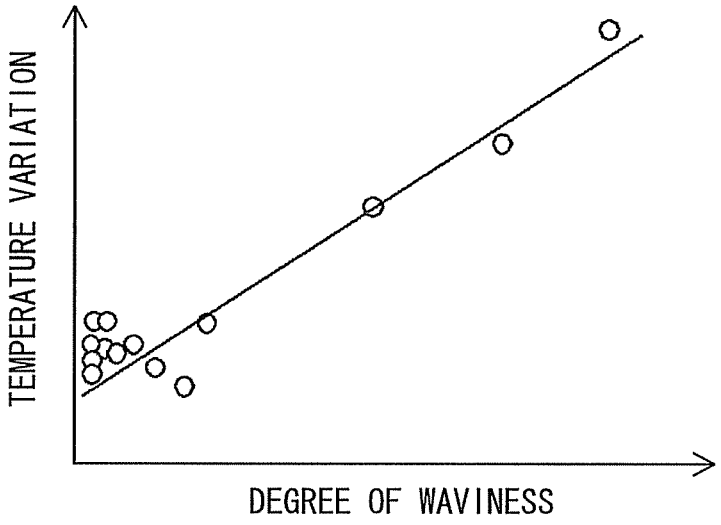
FIG. 4 is a graph showing a relationship between degree of waviness and variations in steel sheet surface temperature.

Between the degree of waviness of the steel sheet 3 and the temperature variation, there is a directly proportional relationship as shown in FIG. 4, and by reducing the degree of waviness to ⅓ or less, material uniformity can be kept within a standard range. In other words, tension of 3.9 MPa or greater is sufficient. If the degree of waviness is further decreased by increasing the tension to 4.9 MPa or greater, or further to 5.9 MPa or greater, the material uniformity also improves accordingly.

On the other hand, from immediately after the trailing end of the steel sheet 3 has passed through the final stand F1 of the finishing mill 2, the tension applied to the steel sheet 3 by the coiler 8 gradually decreases, and when passing through the intermediate stands, for example stand F3 and stand F4 (which then turn off), the rotational speed of the coiler-preceding pinch rolls 7 slows down. Thus, conventionally, when the trailing end of the steel sheet 3 passes through the final stand F7, the trailing end section enters an unpinched state, thus alleviating the tension applied to the leading end side of the steel sheet 3, and as a result, waviness sometimes occurs in the steel sheet 3. In contrast, in the present embodiment, the trailing end of the steel sheet 3 is pinched by the rolled shape correcting pinch rolls 10, and to the region on the downstream side of the position of the rolled shape correcting pinch rolls 10, a suitable amount of tension is applied towards the upstream side in the transferring direction. Consequently, from the leading end to the trailing end, waviness of the steel sheet 3 can be effectively suppressed.

In addition, as described above, because the immediate rapid cooling zone 5*a* is provided in the present embodiment, the surface temperature of the steel sheet 3 after passing through the final stand F7 of the finishing mill 2 can be rapidly lowered to the desired temperature. As a result, because the distance between the final stand F7 and the rolled shape correcting pinch rolls 10 can be shortened, when the trailing end of the steel sheet 3 leaves the final stand F7, the elastic energy stored between the final stand F7 and the rolled shape correcting pinch rolls 10 can be relatively minimized. Consequently, shaking of the trailing end caused by the release of elastic energy can be minimized, enabling waviness in the shape of the steel sheet 3 to be further reduced.

Next, a cooling method for hot rolling, using the cooling apparatus 5 for hot rolling of the present embodiment with the configuration described above, is described below. This cooling method for hot rolling, on the downstream side of the finishing mill 2 of the continuous hot rolling mill, cools the steel sheet 3 rolled by the finishing mill 2 while the steel sheet 3 is being conveyed.

This cooling method for hot rolling includes a first step of controlling the surface temperature of the steel sheet 3 fed out from the final stand F7 of the finishing mill 2 to 850° C. or less by performing cooling in the immediate rapid cooling zone 5*a*, and a second step of pinching the steel sheet 3 by means of the rolled shape correcting pinch rolls 10 and applying tension of 3.9 MPa or greater to the section 3*a* between the position of the final stand F7 and the position where the surface temperature of the steel sheet 3 reaches 850° C. or less.

In the second step, the tension is applied at the position immediately after where the surface temperature of the steel sheet 3 is cooled to 850° C.

Furthermore, in the first step, the lower limit of the surface temperature at the position where the tension is applied in the second step preferably exceeds 650° C.

As described above, in the present embodiment, by providing the rolled shape correcting pinch rolls 10, the shape of the leading end and trailing end of the steel sheet 3 which passes through the inside of the cooling apparatus 5 can be improved in comparison to conventional cases. In particular, in the interval before the cooling state of the steel sheet 3 reaches the transition boiling region, the steel sheet 3 has a flat shape and is cooled uniformly, which enables the temperature difference between the various positions on the surface to be reduced. As a result, defects in terms of the rolled shape and cooling state of the steel sheet 3 can be reduced in comparison to conventional cases, allowing the quality of both the leading end and trailing end of the steel sheet 3 to be improved.

The steel sheet 3 which is cooled to a predetermined temperature by the cooling apparatus 5 is wound onto the coiler 8. The hot-rolled steel sheet obtained in this manner can be widely used as various structural components of an automobile or the like, or can be sent on to a subsequent cold rolling or surface treatment step.

Embodiment 2

Figure 5:
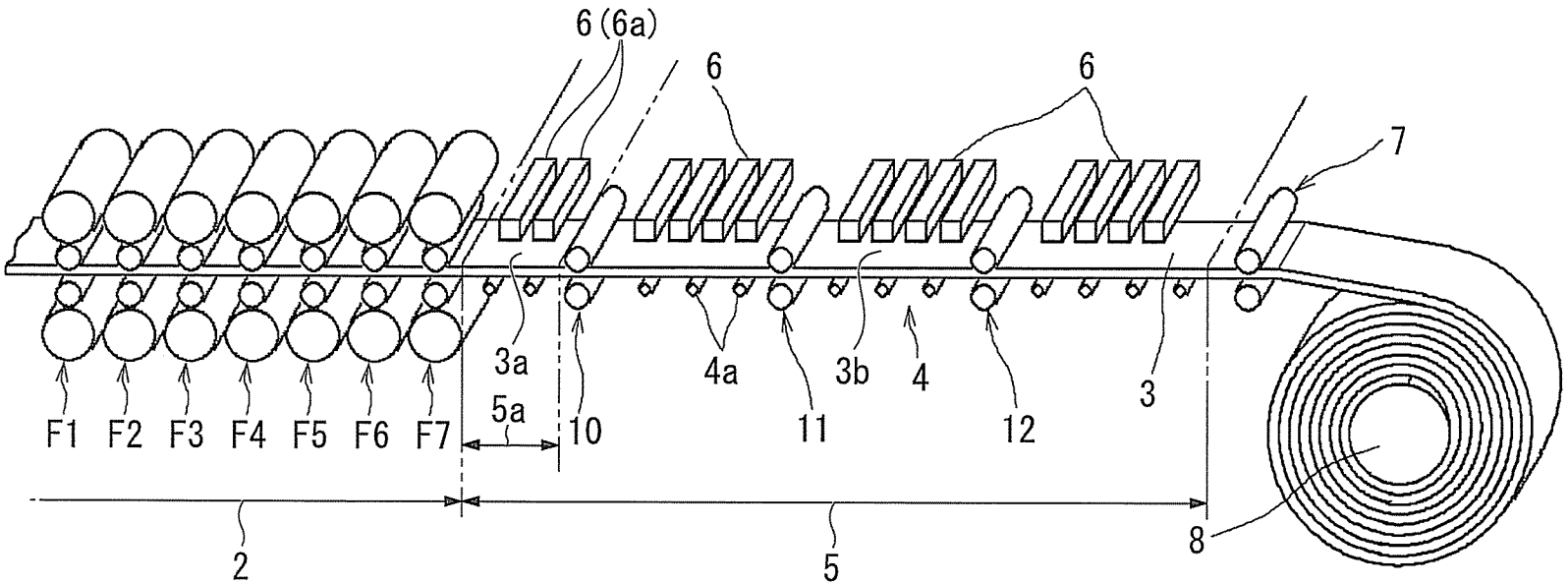
FIG. 5 is a perspective view showing an overview of hot rolling equipment provided with a cooling apparatus for hot rolling according to a second embodiment of the present invention.
Figure 6:
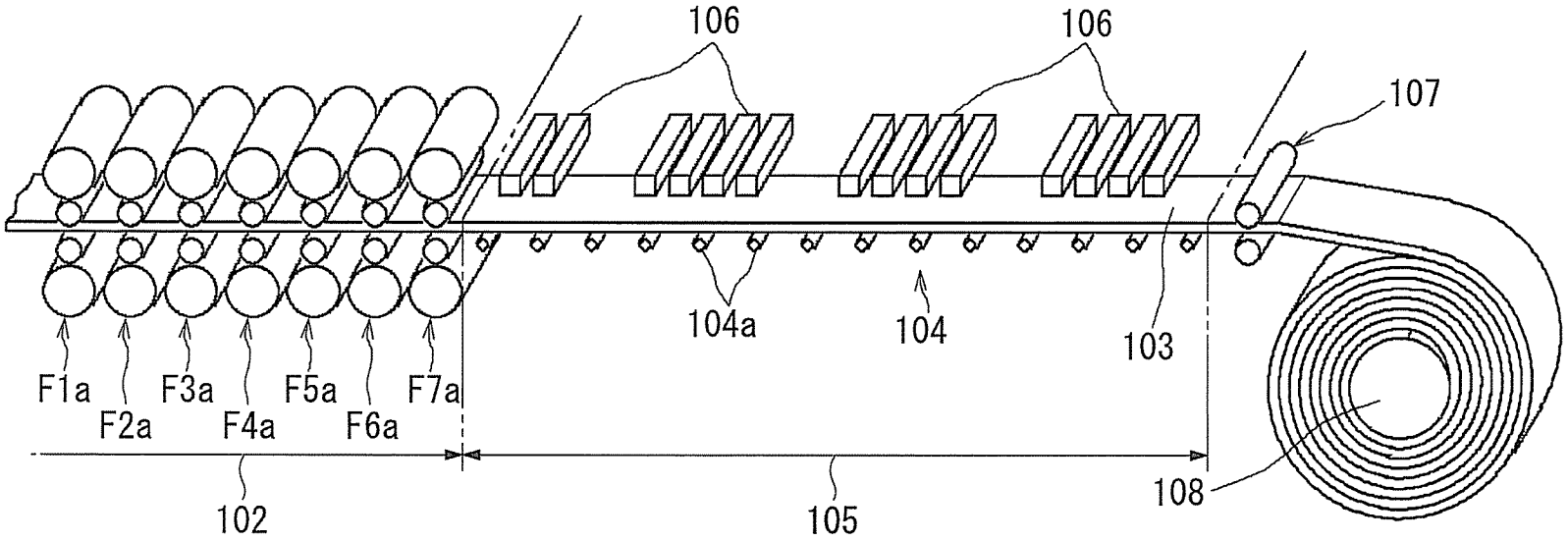
FIG. 6 is a perspective view showing an overview of hot rolling equipment provided with a conventional cooling apparatus for hot rolling.

FIG. 5 shows a second embodiment of the present invention. In the following description, only the points of difference from the first embodiment are described, and any duplicate description is omitted.

In the present embodiment, inside the cooling apparatus 5, first intermediate pinch rolls 11 (second pinch rolls) and second intermediate pinch rolls 12 (third pinch rolls) are provided. Furthermore, the first intermediate pinch rolls 11 are installed at a position where the surface temperature of the steel sheet 3 is 650° C. to 550° C., and the second intermediate pinch rolls 12 are installed at a position where the surface temperature of the steel sheet 3 is 450° C. to 350° C. The first intermediate pinch rolls 11 and the second intermediate pinch rolls 12 each have an upper and lower pair of rolls which, while applying tension of 3.9 MPa or greater to a section 3*b* of the steel sheet 3 between the position where the first intermediate pinch rolls 11 are installed and the position where the second intermediate pinch rolls 12 are installed, pinch the steel sheet 3 at the respective positions.

According to this configuration, a third step of applying tension of 3.9 MPa or greater, to the section 3*b* between the position where the surface temperature is 650° C. to 550° C. and the position where the surface temperature of the steel sheet 3 is 450° C. to 350° C., can be performed.

Figure 7:
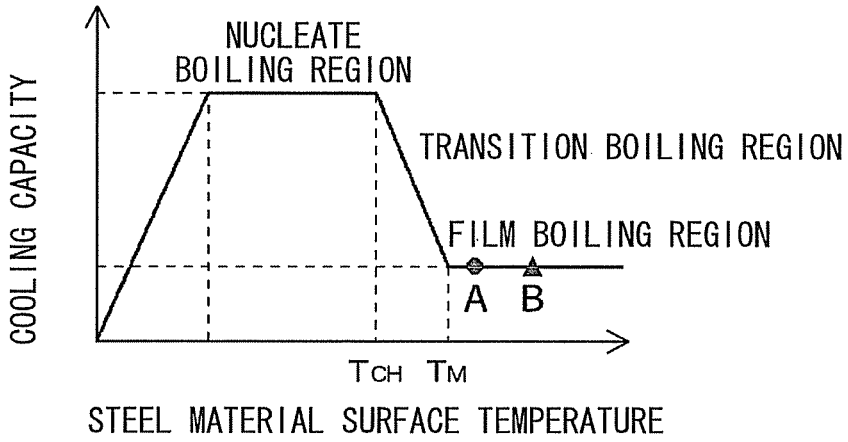
FIG. 7 is a graph showing cooling characteristics when water-cooling steel sheet, wherein the horizontal axis shows the steel material surface temperature, and the vertical axis shows the cooling capacity (more specifically the heat transfer coefficient).
Figure 8:
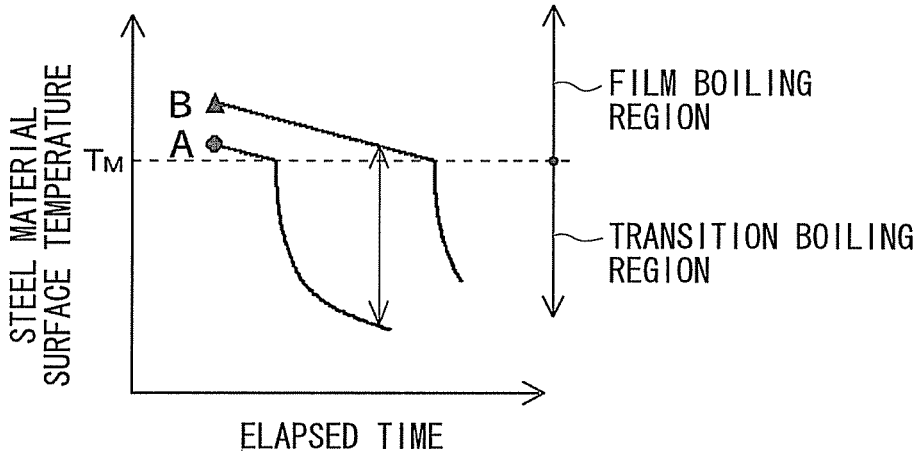
PRIOR ART FIG. 8
FIG. 8 is a graph showing variation in steel material surface temperature for two cases, namely a case where cooling is performed from point A in FIG. 7, and a case where cooling is performed from point B.

The first intermediate pinch rolls 11 are installed at the position where the surface temperature of the steel sheet 3 reaches the maximum temperature $T_M$ of the transition boiling region shown in FIG. 7, and the second intermediate pinch rolls 12 are installed at the position where the surface temperature of the steel sheet 3 reaches the minimum temperature $T_{CH}$ of the transition boiling region shown in FIG. 7. By providing the first intermediate pinch rolls 11 and the second intermediate pinch rolls 12, the section 3*b* of the steel sheet 3 which is the range of the transition boiling region is pinched while being subjected to an appropriate tension, allowing the shape of the steel sheet 3 to maintain a flat state, and vibration of the sheet during threading to be suppressed. Accordingly, by providing the first intermediate pinch rolls 11 and the second intermediate pinch rolls 12 in addition to the rolled shape correcting pinch rolls 10, cooling can be performed in the transition boiling region with even more uniform cooling conditions. Therefore, temperature differences do not occur between positions on the surface of the steel sheet 103, and a higher quality steel sheet 3 can be obtained.

Although preferred embodiments of the present invention were described above, the present invention is not limited only to these examples. Those skilled in the art will appreciate that various modifications and amendments are possible without departing from the technical idea disclosed in the claims, and all such modifications are included within the technical scope of this invention. For example, the rolled shape correcting pinch rolls 10 may be provided at the position where the surface temperature of the steel sheet 3 is 650° C., to also fulfill the role of the first intermediate pinch rolls 11. However, in this case, a need arises to control the tension on both the upstream side and the downstream side of the rolled shape correcting pinch rolls 10 installed at the new position, and this control can be complicated. Therefore, the configuration of the embodiment 2 is preferred.

INDUSTRIAL APPLICABILITY

The present invention can be applied to a cooling apparatus and cooling method which performs a cooling step after a finishing step in the continuous hot rolling of a steel sheet.

BRIEF DESCRIPTION OF THE REFERENCE SYMBOLS

2 Finishing mill
3 Steel sheet
4 Run-out table
5 Cooling apparatus
6 Cooling unit
7 Coiler-preceding pinch rolls
8 Coiler
10 Rolled shape correcting pinch rolls (first pinch rolls)
11 First intermediate pinch rolls (second pinch rolls)
12 Second intermediate pinch rolls (third pinch rolls)

The invention claimed is:

1. A cooling apparatus for hot rolling which is installed on a downstream side of a finishing mill of a continuous hot rolling mill, and cools a steel sheet rolled by the finishing mill while being conveyed, the apparatus comprising:

first pinch rolls which, during an interval when the steel sheet fed out from a final stand of the finishing mill moves from a position of the final stand to a position where a surface temperature of the steel sheet reaches 850° C. or less, pinch the steel sheet while applying tension of 3.9 MPa or greater, the first pinch rolls being installed at a position immediately after where the surface temperature of the steel sheet is cooled to 850° C., second pinch rolls being installed at a position where a surface temperature of the steel sheet is from 650° C. to 550° C., third pinch rolls being installed at a position where a surface temperature of the steel sheet is from 450° C. to 350° C., and a rapid cooling unit configured to rapidly cool the steel sheet to a temperature of 850° C. or lower at an immediate rapid cooling zone provided between the final stand and the first pinch roll, wherein the second pinch rolls and the third pinch rolls apply tension of 3.9 MPa or greater between the position of the steel sheet where the second pinch rolls are installed and the position of the steel sheet where the third pinch rolls are installed.

2. The cooling apparatus for hot rolling according to claim 1, wherein a lower limit of the surface temperature of the steel sheet at a position where the tension is applied exceeds 650° C.

3. A cooling method for hot rolling, that, on a downstream side of a finishing mill of a continuous hot rolling mill, cools a steel sheet rolled by the finishing mill while being conveyed, the method comprising:

a first step of controlling a surface temperature of the steel sheet fed out from a final stand of the finishing mill to 850° C. or lower;

a second step of pinching the steel sheet while applying tension of 3.9 MPa or greater, from a position of the final stand to a position where a surface temperature of the steel sheet reaches 850° C. or less;

a third step in which, between a position where the surface temperature of the steel sheet reaches 650° C. to 550° C., and a position where the surface temperature of the steel sheet reaches 450° C. to 350° C., tension of 3.9 MPa or greater is applied, and a rapid cooling step wherein the steel sheet is rapidly cooled in a region between the final stand and a position at which the surface temperature of the steel sheet becomes 850° C., wherein in the second step of pinching the steel sheet, the tension is applied at a position immediately after where the surface temperature of the steel sheet cools to 850° C.

4. The cooling method for hot rolling according to claim 3, wherein, in the first step, a lower limit of the surface temperature at a position where the tension is applied in the subsequent second step is a temperature exceeding 650° C.

* * * * *